US009057372B2

(12) United States Patent
Wakefield et al.

(10) Patent No.: US 9,057,372 B2
(45) Date of Patent: Jun. 16, 2015

(54) GEAR ROOT GEOMETRY FOR INCREASED CARRYOVER VOLUME

(75) Inventors: David L. Wakefield, Loves Park, IL (US); Weishun Ni, Rockton, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 632 days.

(21) Appl. No.: 12/960,599

(22) Filed: Dec. 6, 2010

(65) Prior Publication Data

US 2012/0141316 A1 Jun. 7, 2012

(51) Int. Cl.
*F04C 2/08* (2006.01)
*F04C 2/14* (2006.01)

(52) U.S. Cl.
CPC ..... *F04C 2/14* (2013.01); *Y10T 29/49242* (2013.01); *Y10T 74/19963* (2013.01); *F04C 2/084* (2013.01); *F04C 2/088* (2013.01)

(58) Field of Classification Search
USPC ..... 418/205, 206.1, 206.5
See application file for complete search history.

(56) References Cited

U.S. PATENT DOCUMENTS 3,817,117 A * 6/1974 Kita et al. ..... 74/462
3,994,617 A 11/1976 McCombs
3,996,964 A 12/1976 McCombs
4,302,683 A 11/1981 Burton
4,619,594 A 10/1986 Moir
4,627,568 A 12/1986 Lortie et al.
4,682,938 A 7/1987 Riordan
4,730,772 A 3/1988 Lortie et al.
5,037,283 A 8/1991 Kapur et al.
5,195,401 A 3/1993 Mouton
5,303,546 A 4/1994 Farrell
5,888,752 A 3/1999 Malin et al.
6,042,352 A 3/2000 Halter et al.
6,209,495 B1 4/2001 Warren
6,398,528 B1 6/2002 Hansen et al.
6,666,015 B2 12/2003 Dyer
6,776,594 B1 8/2004 Heng-I et al.
7,094,042 B1 8/2006 Borgetti et al.
7,096,657 B2 8/2006 Mahoney et al.
7,165,949 B2 1/2007 Firnhaber
7,182,803 B2 2/2007 Stewart et al.
7,360,639 B2 4/2008 Sprouse et al.
7,513,761 B2 * 4/2009 Lindgren ..... 418/201.3
7,637,724 B2 12/2009 Cygnor
7,798,781 B2 9/2010 Parsons et al.
7,810,309 B2 10/2010 Parsons et al.
2010/0158738 A1 * 6/2010 Heitz ..... 418/206.1

OTHER PUBLICATIONS

Definition of Gear Terms_Gears and Stuff from the Internet at www.gearsandstuff.com/gear_terms_and_definitions_2006.*

* cited by examiner

*Primary Examiner* — Mary A Davis
*Assistant Examiner* — Paul Thiede
(74) *Attorney, Agent, or Firm* — Carlson, Gaskey & Olds, P.C.

(57) ABSTRACT

A gear includes a gear root defined by a stretched root blended into an involute tooth profile curve within a True Involute Form diameter.

16 Claims, 6 Drawing Sheets

GEAR ROOT GEOMETRY FOR INCREASED CARRYOVER VOLUME

BACKGROUND

The present disclosure relates to a gear pump, and more particularly to the gear geometry thereof.

Gear pumps have historically experienced damage at the gear roots due to cavitation which occurs when local pressure falls below the fluid's vapor pressure. Formation of vapor bubbles and the subsequent collapse thereof may result in the damage.

SUMMARY

A gear according to an exemplary aspect of the present disclosure includes a gear root defined by a stretched root blended into an involute tooth profile curve within a True Involute Form diameter.

A gear pump according to an exemplary aspect of the present disclosure includes a first and second meshed gear with a multiple of gear roots each defined by a stretched root blended into an involute tooth profile curve within a True Involute Form diameter.

A method of installing a gear within a gear pump according to an exemplary aspect of the present disclosure includes meshing a first gear with a second gear such that a gear mesh therebetween is provided with an enlarged carry-over volume greater than that provided by a standard full fillet root profile.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
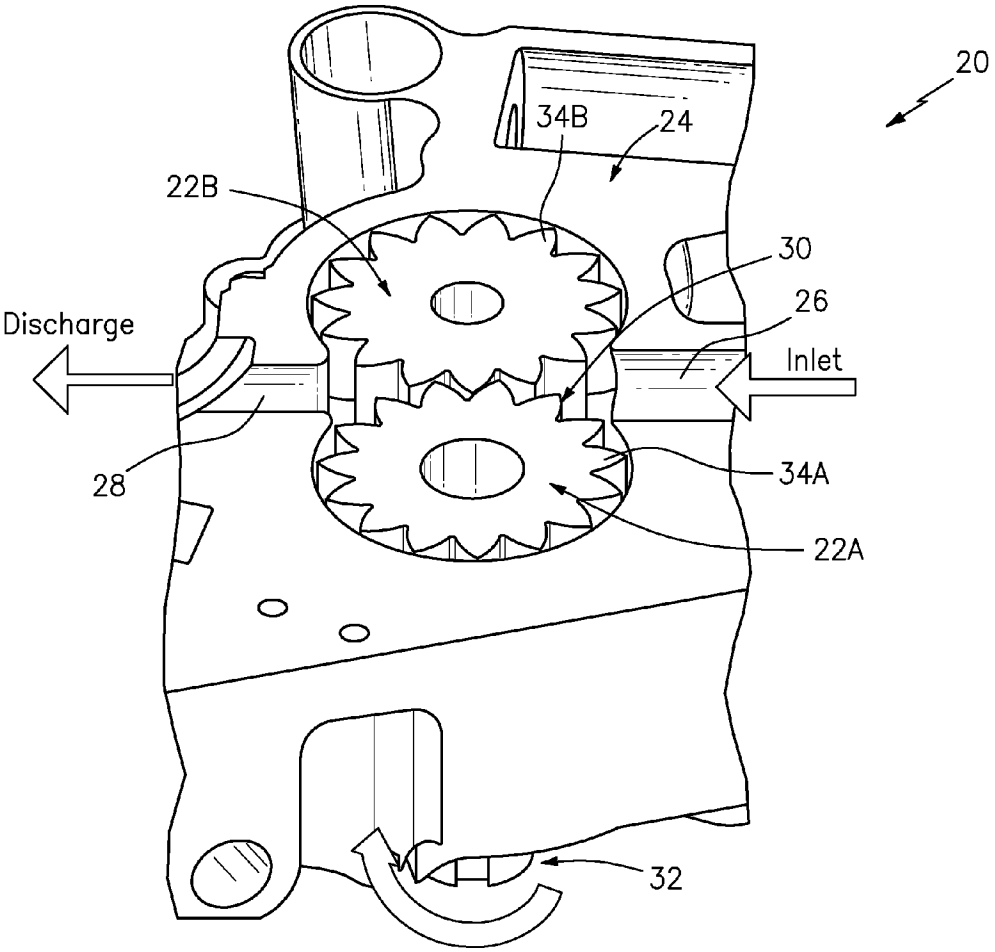
FIG. 1 is a schematic view of a gear pump.

FIG. 1 schematically illustrates a gear pump 20 typical of an aerospace fluid pump operable to pump fuel, lubricant or other fluid. A pair of meshed straight-cut spur gears 22A, 22B are parallel mounted within a housing 24 having an inlet 26 and a discharge 28 in communication with a cavity 30 within which the meshed gears 22A, 22B are received. One of the meshed gears 22A is driven by an input shaft 32 which extends from the housing 24 to receive a drive input while the other gear 22B is journaled in the housing 24 as an idler and rotates because of the meshed engagement with the externally driven gear 22A. As the meshed gears rotate in opposite directions successive trapped volumes of fluid are carried by each gear 22A, 22B from the inlet 26 to the discharge 28.

Figure 2:
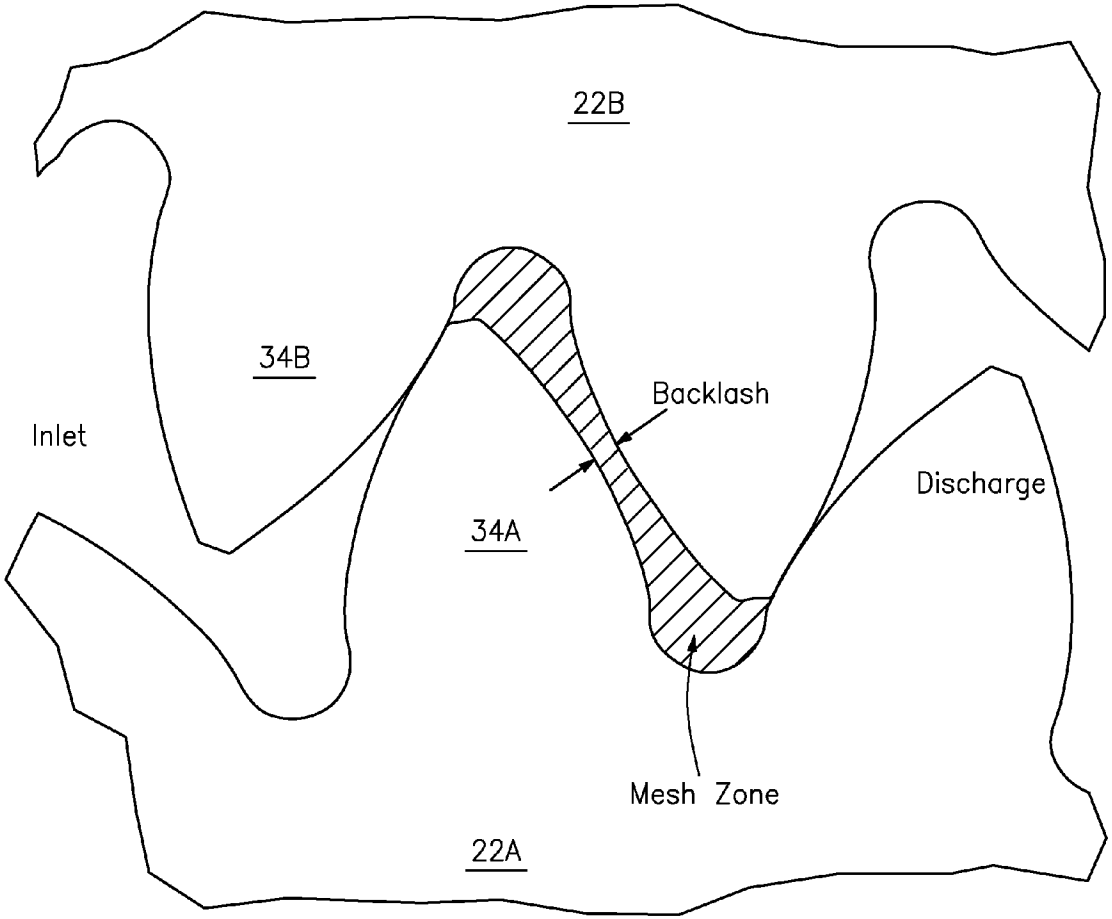
FIG. 2 is a schematic view of a mesh zone at or near the tightest mesh to backlash.

Gear teeth 34A, 34B of the gears 22A, 22B move through a mesh zone FIG. 2, which separates the pump discharge 28 from pump inlet 26. The mesh zone is defined by the contact between the gear teeth 34A, 34B which forms a seal to prevent leakage from the high pressure pump discharge 28 to the low pressure pump inlet 26. As the gears 22A, 22B enter the mesh zone, the decrease in cavity volume displaces the fluid which causes an increase in fluid pressure.

Figure 3:
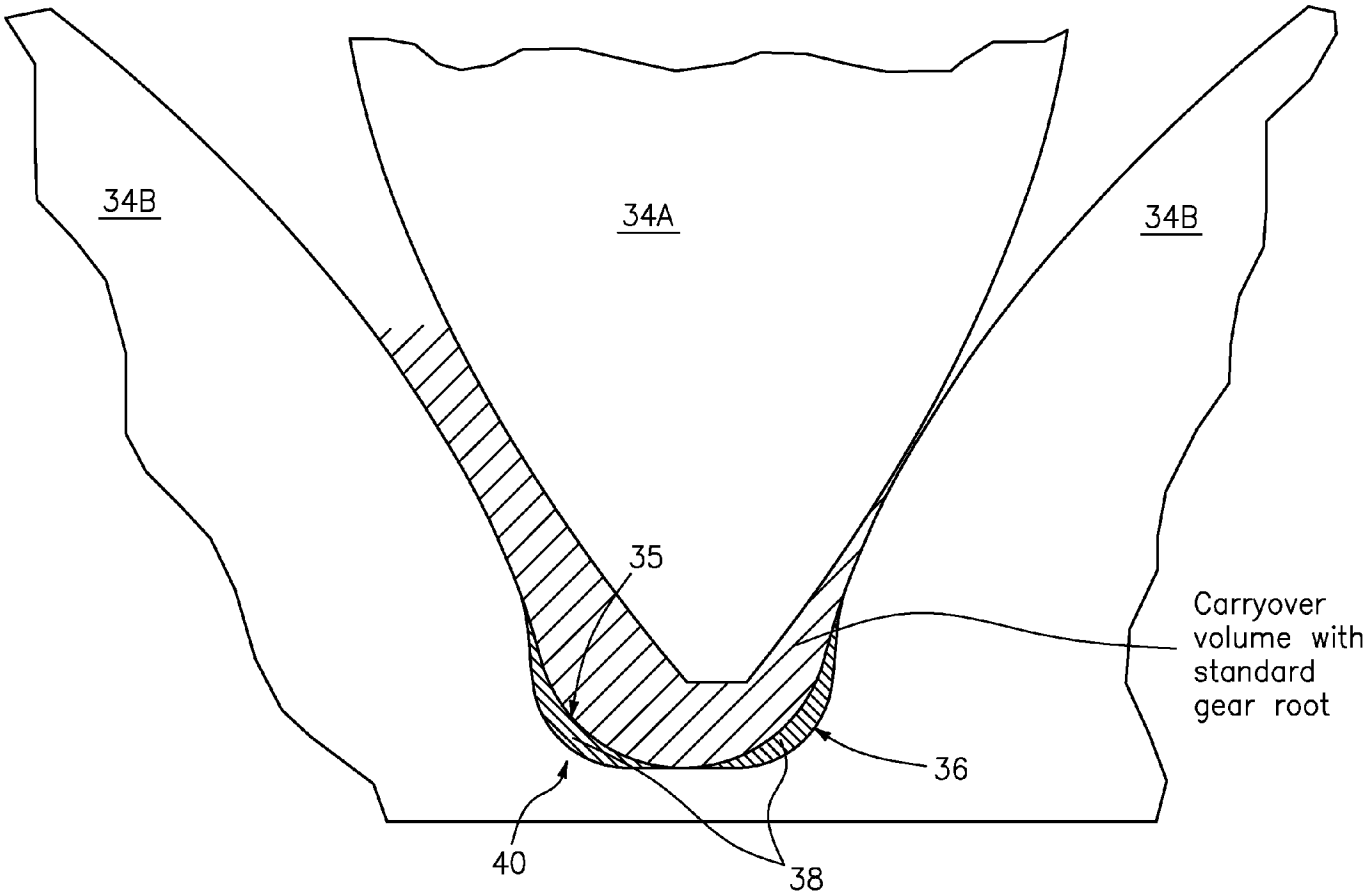
FIG. 3 is an expanded view of a gear mesh which illustrates a modified gear tooth root profile geometry versus a standard fillet root.

With reference to FIG. 3, at or near the point of tightest mesh to the backlash (FIG. 2), the volume between the teeth 34A, 34B is at a minimum. This minimum volume is referred to herein as carry-over (or trapped) volume, since the fluid trapped therein is carried over from discharge 28 back toward the inlet 26 because the fluid contained therein is not displaced as part of the pumped fluid to the discharge 28. Continued rotation beyond the tightest mesh minimum volume point begins to increase the volume. Fluid from the inlet must then flow into this expanding volume and fluid pressure is reduced since the energy required to induce the flow comes from the conversion of static fluid pressure into dynamic (flow) velocity energy.

During approach to the tightest mesh minimum volume point, there is some small degree of compressibility in the fluid such that the carry-over volume essentially operates as a spring to absorb some of the compression energy. Applicant has determined that an increase in the carry-over volume as compared to a standard full filet root profile 35 increases the energy storage capability and essentially provides a larger spring. That is, an enlarged carry-over volume 38 decreases the rate of pressure increase as the gears 34A, 34B approach the tightest mesh minimum volume point. Then, as the gear teeth 34A, 34B leave the tightest mesh minimum volume point, the energy stored in the fluid is released which thereby increases the effective fluid pressure and decreases the loss of pressure within the fluid which flows in from the inlet 26.

A modified gear root geometry 36 provides the desired enlarged carry-over volume 38 as compared to the standard full fillet root profile 35 to mitigate the effects of fluid displacement. "Standard full fillet root profile" as defined herein may be considered that which provides a constant radius which extends in a continuous arc from one tooth to the next. The typical geometry for a spur gear tooth root is a full fillet which is tangent to the involute tooth profile and simultaneously tangent to the root diameter. The lowest point of the constant radius fillet establishes the root diameter. In the case of hobbed gears, the geometry is generated by the path the tool tip follows as the teeth are cut. For form ground teeth, the radius is formed on the extremity of the grinding wheel. The adjacent sides of two teeth and the root between them is formed at the same time by the grinding wheel that conforms to the net finished profile of the space between the teeth.

The effects from the enlarged carry-over volume 38 of the modified gear root geometry 36 tend to reduce the phenomenon of cavitation within the gear mesh zone. A reduction in the dynamic pressure loss on the inlet side of the trapped volume increases the available static pressure which reduces the tendency to form bubbles within the fluid due to the fall of the local fluid pressure below the fluid's true vapor pressure (TVP) and suppresses bubble formation. Suppression of bubble formation reduces the incidence of cavitation. The reduced pressure spike generated in the trapped volume as the teeth approach the tightest mesh minimum volume point in turn reduces the total energy which collapses any bubbles that may have formed. This decreases the cavitation erosion power and the severity of damage if cavitation does occur.

In one non-limiting embodiment, the enlarged carry-over volume 38 provides an approximate 7% increase as compared to the standard full fillet root profile 35. It should be understood that the magnitude of increase may be greater or smaller dependent upon the actual gear geometry and the practical manufacturing tolerances.

Figure 4:
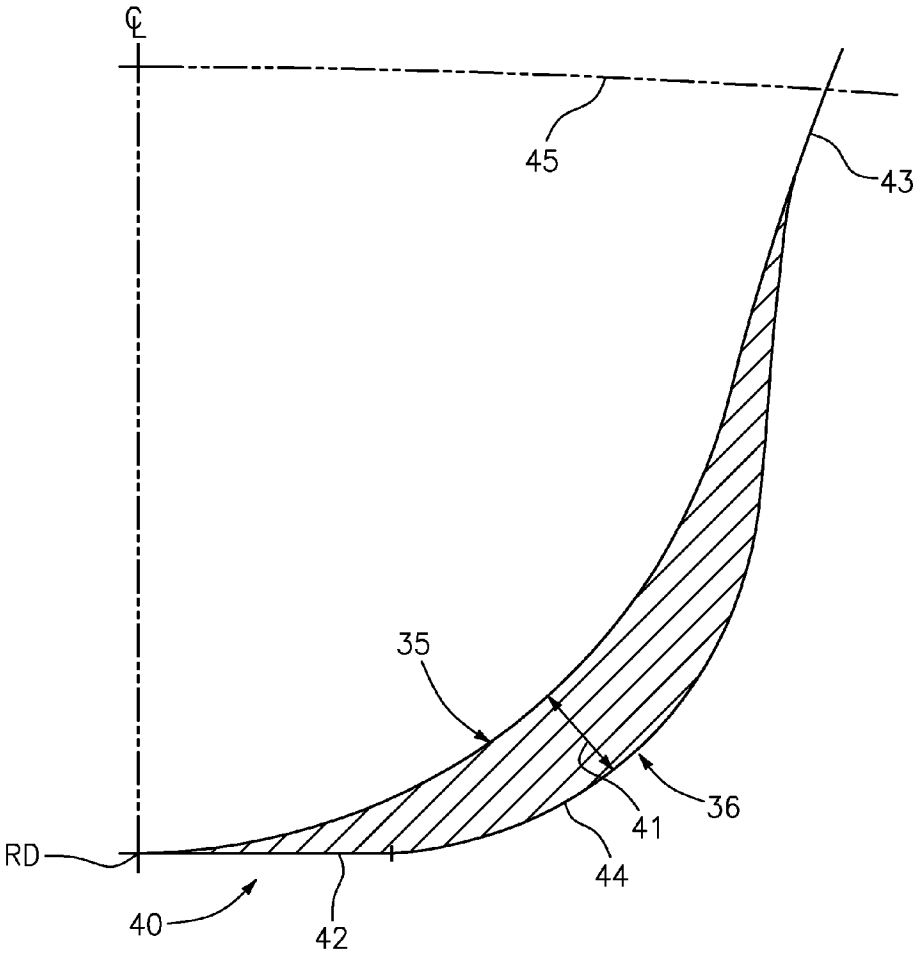
FIG. 4 is an expanded view of a modified gear tooth root profile with an increased carryover volume.
Figure 5:
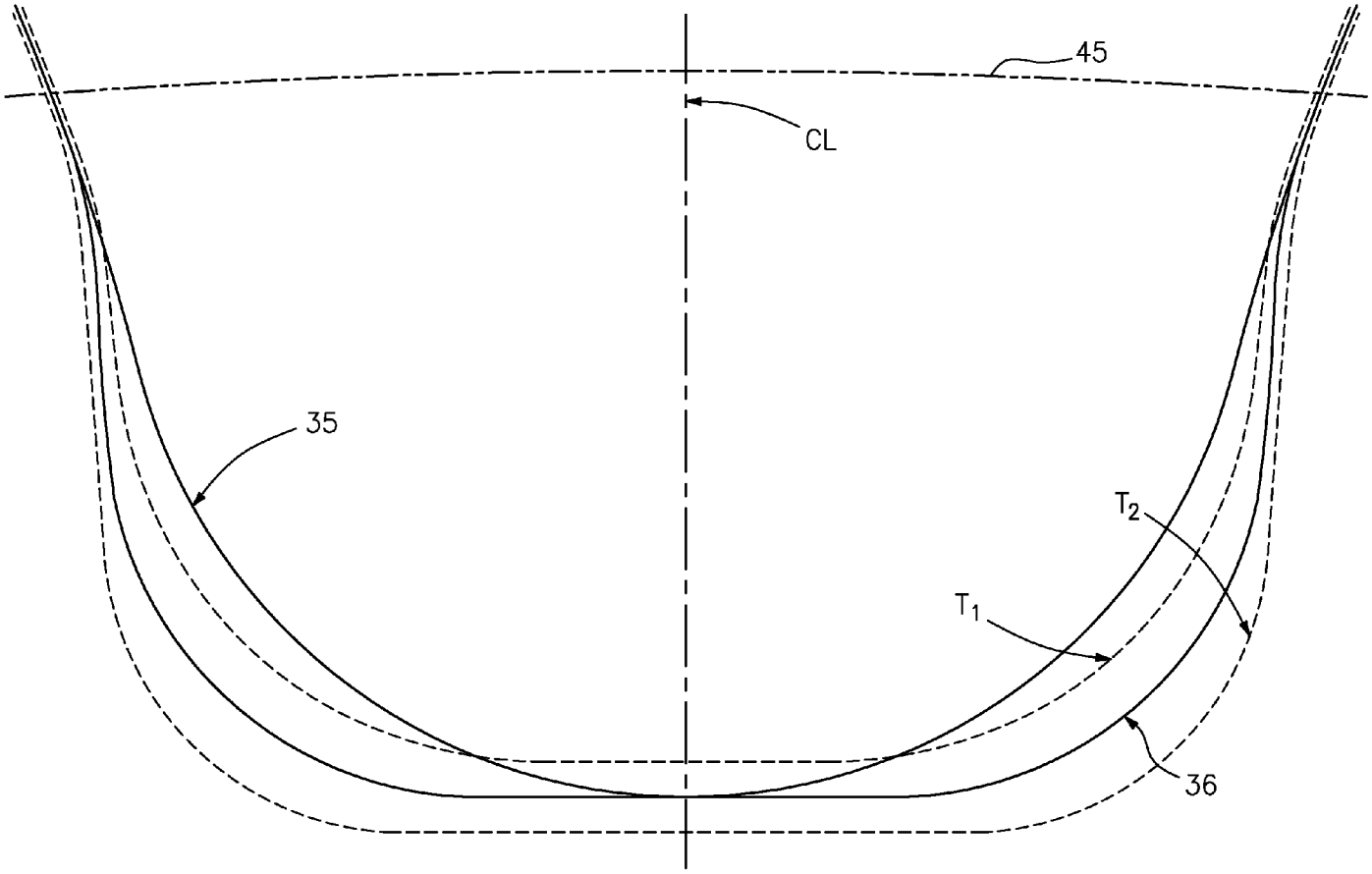
FIG. 5 is an expanded maximum/minimum material relationship between the modified gear tooth root profile geometry versus the standard fillet root.
Figure 6:
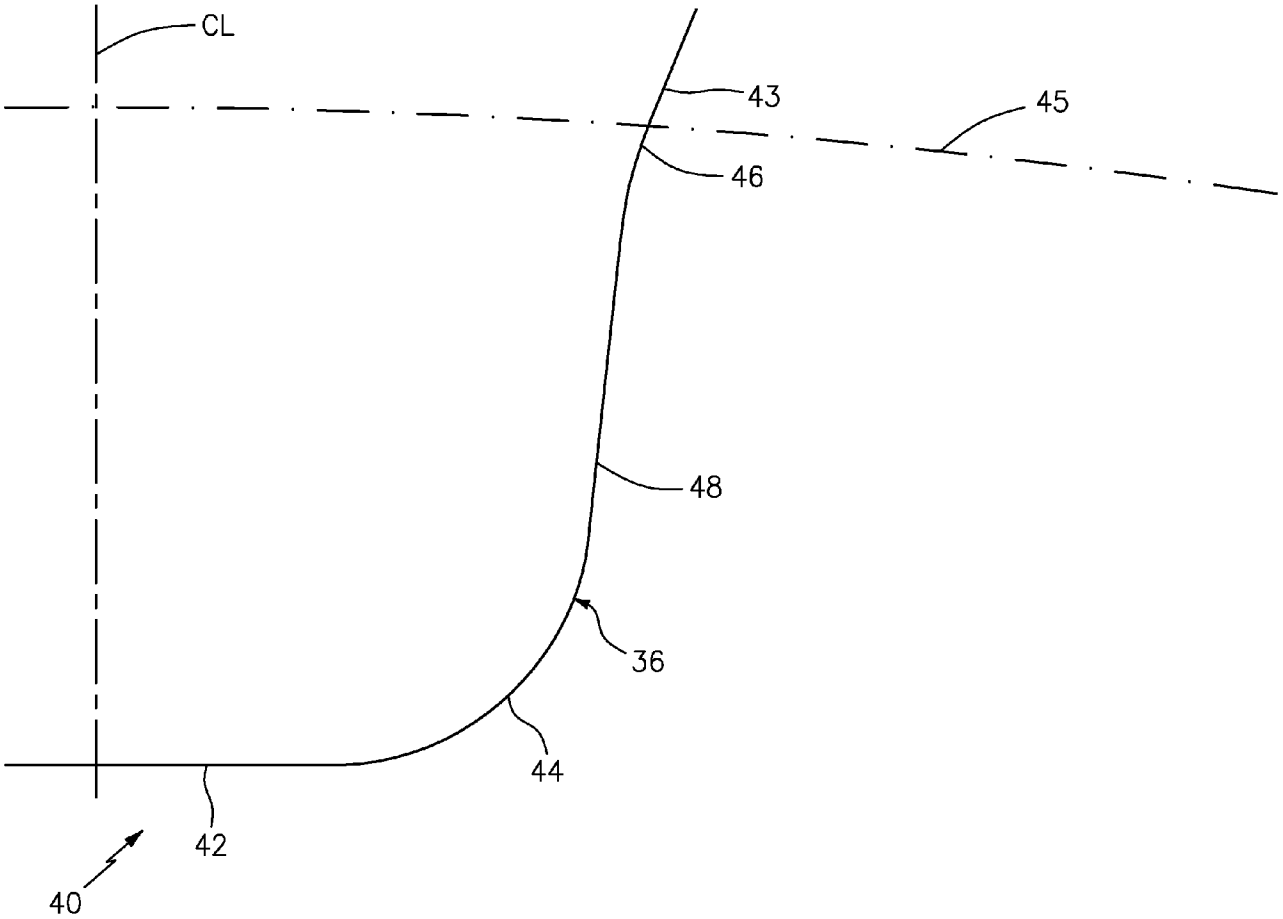
FIG. 6 is an expanded view of the modified gear tooth root profile.

With reference to FIG. 4, the enlarged carry-over volume 38 may be defined within each gear root 40 by stretching the root circumferentially at the root diameter to form a root flat 42 which extends tangent to the defined root diameter RD from the tooth space centerline CL then blended at a blend 44 into an involute tooth profile curve 43 within the True Involute Form (TIF) diameter 45 (FIG. 5). That is, the gear root 40 is defined by a stretched root 41 blended into a flat side 48 at the widest possible spacing and shallowest angle toward zero for maximum carry-over volume, which may be blended into the specified tooth profile curve 43 at a fillet radius 46 located within the True Involute Form (TIF) diameter 45 to ensure proper gear tooth meshing action (FIG. 6).

To maximize the increase in root carry-over volume 38, the tangent point between the fillet radius 46 and the specified tooth profile curve is located as close to the True Involute Form (TIF) diameter 45 as possible with a minimization of tolerances $T_1$ and $T_2$ on the width of the root modification (FIG. 5). As the modified gear root geometry 36 must not extend beyond the True Involute Form (TIF) diameter 45. That is, the modified gear root geometry 36 is constrained radially within the True Involute Form (TIF) diameter 45.

It should be understood that although the root flat 42 is illustrated in the disclosed non-limiting embodiment, other extensions from the defined root diameter RD which do not extend radially inward thereof may alternatively be provided. It should be understood, however, that various blend profiles to include multiple segments, undercuts and other geometry which provide the enlarged carry-over volume 38 may alternatively or additionally be provided.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A gear comprising:

a plurality of involute gear teeth including first and second neighboring gear teeth each having a respective tooth profile curve that extends diametrically inwards of a true involute form diameter, said first and second neighboring gear teeth defining a tooth space centerline there between;

a gear root geometry between said first and second neighboring gear teeth, said gear root geometry defining a gear root diameter and including a gear root flat that is tangent to said gear root diameter at said tooth space centerline, first and second radiused fillets flanking, respectively, said gear root flat, said first and second radiused fillets joining said gear root flat to, respectively, first and second upper flats, said first and second upper flats blending into said tooth profile curves at locations diametrically inside of said true involute form diameter.

2. The gear as recited in claim 1, wherein said gear root flat is perpendicular to said tooth space centerline.

3. The gear as recited in claim 1, wherein said gear root flat is diametrically inwards of an imaginary standard full fillet root profile that has a constant radius that extends in a continuous arc between said first and second neighboring gear teeth.

4. The gear as recited in claim 1, wherein said gear root diameter is a diametrically lowest point of the gear root geometry.

5. The gear as recited in claim 1, wherein said involute tooth profile curves of said first and second neighboring gear teeth face towards each other.

6. The gear as recited in claim 1, wherein said gear root geometry is symmetric about said tooth space centerline.

7. The gear as recited in claim 6, wherein said gear root flat is diametrically inwards of an imaginary standard full fillet root profile that has a constant radius that extends in a continuous arc between said first and second neighboring gear teeth, said gear root geometry including first and second equivalent expanded carryover volumes, relative to said imaginary standard full fillet root profile, said first equivalent expanded carryover volume being bounded by said imaginary standard full fillet root profile, a portion of said gear root flat to one side of said tooth space centerline, and said first radiused fillet, and said second carryover volume being bounded by said imaginary standard full fillet root profile, a portion of said gear root flat to the other side of said tooth space centerline, and said second radiused fillet.

8. The gear as recited in claim 1, wherein said involute gear teeth are on a straight spur gear.

9. A method of assembling a gear pump comprising:

meshing a first gear with a second gear within the gear pump such that a gear mesh therebetween is provided with an enlarged carry-over volume greater than that provided by a standard full fillet root profile, said carry-over volume being provided in part by a gear root geometry between first and second neighboring involute gear teeth of said first gear, said first and second neighboring gear teeth each having a respective tooth profile curve that extends diametrically inwards of a true involute form diameter, said first and second neighboring gear teeth defining a tooth space centerline there between, said gear root geometry defining a gear root diameter and including a gear root flat that is tangent to said gear root diameter at said tooth space centerline, first and second radiused fillets flanking, respectively, said gear root flat, said first and second radiused fillets joining said gear root flat to, respectively, first and second upper flats, said first and second upper flats blending into said tooth profile curves at locations diametrically inside of said true involute form diameter.

10. A method as recited in claim 9, wherein the enlarged carry-over volume is bounded by a root diameter and said true involute form diameter.

11. The method as recited in claim 9, wherein said first gear is a straight spur gear.

12. A gear pump comprising:

a first gear;

a second gear meshed with said first gear in a mesh zone, said first gear and said second gear each including a respective plurality of involute gear teeth, each of said gear teeth including a respective tooth profile curve that extends diametrically inwards of a true involute form diameter, neighboring ones of said gear teeth defining a tooth space centerline there between with gear root geometries between neighboring ones of said gear teeth, said gear root geometries each defining a gear root diameter and including a gear root flat that is tangent to said gear root diameter at said tooth space centerline, first and second radiused fillets flanking, respectively, said gear root flat, said first and second radiused fillets joining said gear root flat to, respectively, first and second upper flats, said first and second upper flats blending into said tooth profile curves at locations diametrically inside of said true involute form diameter.

13. The gear pump as recited in claim 12, wherein said first gear and said second gear define a carry-over volume in said mesh zone, said carry-over volume being approximately 7% greater than an imaginary standard full fillet root profile that has a constant radius that extends in a continuous arc between said neighboring ones of said gear teeth.

14. The gear pump as recited in claim 12, wherein said gear root geometry is symmetric about said tooth space centerline.

15. The gear pump as recited in claim 14, wherein said gear root flat is diametrically inwards of an imaginary standard full fillet root profile that has a constant radius that extends in a continuous arc between said first and second neighboring gear teeth, said gear root geometry including first and second equivalent expanded carryover volumes, relative to said imaginary standard full fillet root profile, said first equivalent expanded carryover volume being bounded by said imaginary standard full fillet root profile, a portion of said gear root flat to one side of said tooth space centerline, and said first radiused fillet, and said second carryover volume being bounded by said imaginary standard full fillet root profile, a portion of said gear root flat to the other side of said tooth space centerline, and said second radiused fillet.

16. The gear pump as recited in claim 12, wherein said first and second gears are straight spur gears.

* * * * *